US007428975B2

(12) United States Patent
Bradford

(10) Patent No.: US 7,428,975 B2
(45) Date of Patent: Sep. 30, 2008

(54) COMBINATION OF PARTITION ASSEMBLY AND CONTAINER AND METHOD OF USE

(75) Inventor: Judson A. Bradford, Holland, MI (US)

(73) Assignee: Bradford Company, Holland, MI (US)

( * ) Notice: Subject to any disclaimer, the term of this patent is extended or adjusted under 35 U.S.C. 154(b) by 950 days.

(21) Appl. No.: 10/629,726

(22) Filed: Jul. 29, 2003

(65) Prior Publication Data

US 2005/0023281 A1 Feb. 3, 2005

(51) Int. Cl.
*B65D 1/24* (2006.01)
*B65D 25/04* (2006.01)
*B65D 85/00* (2006.01)

(52) U.S. Cl. ..... 220/529; 220/552

(58) Field of Classification Search ..... 220/528, 220/529, 545, 552, 550; 229/198.3, 198.3 Q; 190/109, 110; 150/112, 113
See application file for complete search history.

(56) References Cited

U.S. PATENT DOCUMENTS 3,491,909 A * 1/1970 Ikelheimer ..... 217/7
4,403,638 A * 9/1983 Baum ..... 206/316.2
4,595,246 A * 6/1986 Bross ..... 312/348.3
4,610,286 A * 9/1986 Cyr ..... 206/316.2
4,842,032 A * 6/1989 Mastronardo ..... 206/308.1
4,879,854 A * 11/1989 Handler ..... 52/238.1
5,069,514 A * 12/1991 Sherman ..... 312/348.3
6,189,697 B1 * 2/2001 Davis ..... 206/581
6,231,099 B1 * 5/2001 Greenwald ..... 296/37.8
6,491,194 B2 * 12/2002 Marvin ..... 224/483
6,535,606 B2 * 3/2003 Cox ..... 379/449
6,640,944 B2 * 11/2003 Adams ..... 190/110

* cited by examiner

*Primary Examiner*—Anthony D Stashick
*Assistant Examiner*—Harry A Grosso
(74) *Attorney, Agent, or Firm*—Wood, Herron & Evans, LLP

(57) ABSTRACT

A method and apparatus is provided for removably securing a partition assembly inside a container without bending the individual partitions of the partition assembly. The partition assembly divides the space inside the container into separate cells. The assembly comprises a plurality of first slotted partitions intersecting with a plurality of second slotted partitions to form a matrix. The matrix is held in the container with hook and loop fasteners.

17 Claims, 2 Drawing Sheets

COMBINATION OF PARTITION ASSEMBLY AND CONTAINER AND METHOD OF USE

FIELD OF THE INVENTION

The present invention relates to a partition assembly for dividing the space inside a container or box; more particularly to a partition assembly which may be used with containers or boxes of different sizes.

DESCRIPTION OF THE PRIOR ART

In the storage, shipment or display of parts or merchandise, it is a common practice to divide the interior of a box or container into a plurality of individual cells. The interior of a box or container is typically separated by a series of dividers, one set of parallel dividers being orthogonal to a second set of dividers. The dividers separate the interior of the container into a plurality of individual cells, each of which is intended to hold a separate item for display or shipment. The division of the interior of the box or container helps prevent the items therein from contacting one another and breaking during shipping. The division or partitioning of the container also aids in the loading and unloading of the items therein, as well as inventorying the contents of each box or container.

The dividers typically are slotted and arranged in an orthogonal relationship to divide the interior of the box or container into a desired number of cells. The dividers are slotted in a manner that enables the dividers to engage with one another at the location of the slots so that the dividers form an orthogonal grid or matrix. Typically the dividers are made of the same material as the material of the box or container, plastic or paperboard. However, the dividers may be constructed of any suitable material with sufficient rigidity to prevent the contents of the container from contacting one another and being damaged.

Traditional partition assemblies comprise a series of individual slotted dividers which mesh together in an orthogonal grid or matrix. The individual dividers of the assembly may be individually removable from the assembly or not. The individual dividers of the assembly extending in the same direction are typically the same length. The individual dividers of the partition assembly extending in one direction may be the same length as the individual dividers of the assembly extending in the perpendicular direction, thereby creating a square partition assembly. However, the individual dividers of the partition assembly extending in one direction may be a different length than the individual dividers of the assembly extending in the perpendicular direction, thereby creating a rectangular partition assembly.

Different methods of securing a partition assembly inside the interior of a box or container have been utilized to prevent the partition assembly from separating from the box or container. One method of securing a partition assembly inside the interior of a box or container requires that the individual partitions of the partition assembly be of a length greater than either the length or width of the interior of the box or container. Provided the length of these individual dividers is greater than the corresponding dimension of the interior of the container in which the partition assembly is to be used, the individual dividers are bent and then stapled or otherwise secured to the container walls. Several U.S. patents disclose partition assemblies having individual partitions which are bent and then stapled to the container walls to secure the partition assembly in the interior of the box or container in order to create a plurality of cells. U.S. Pat. Nos. 1,235,886 and 2,643,810 disclose partition assemblies secured inside the interior of a box or container in this manner.

If the length of the individual partitions of the partition assembly is less than the corresponding dimension of the interior of the container (length or width) in which the partition assembly is to be used, the partition assembly typically is not be secured to the container. The partition assembly may fall out of the interior of the container if the container is tilted or turned over.

Therefore, the individual partitions of the partition assembly must intentionally be made longer than the width or length of the interior of the container, so that the partition assembly may be secured inside the interior of the container. The increased length of the individual partitions is costly to the manufacturer due to the added material necessary for the individual partitions.

Often it is desirable to use the same partition assembly inside different containers or boxes. These containers or boxes may have slightly different interior dimensions. If the interior of a container is slightly larger than anticipated, it may be difficult to secure the individual partitions of the partition assembly to the walls of the container or box.

It has therefore been one objective of the invention to provide a partition assembly which may be secured inside a container with hook and loop fasteners such that the individual partitions of the partition assembly are not bent.

It has been another objective of the present invention to provide a method of removably securing a partition assembly inside containers of different sizes with hook and loop fasteners such that the individual partitions of the partition assembly are not bent.

SUMMARY OF THE INVENTION

The combination partition assembly and container of the present invention which accomplishes these objectives comprises a partition assembly which may be removably secured inside the interior of the container with hook and loop fasteners such that the individual partitions of the partition assembly are not bent or otherwise deformed. The method of the present invention enables a partition assembly of a predetermined size to be removably secured in containers of slightly different sizes without having to bend the partitions.

The partition assembly comprises a plurality of first slotted partitions intersecting with a plurality of second slotted partitions at intersections. Preferably, both first and second slotted partitions are made of plastic but may be made of any material. When the partition assembly is placed inside a container, the intersecting first and second slotted partitions form a plurality of holding cells into which different parts are stored for shipment or display.

Each first slotted partition has a series of slots extending inwardly from an edge of the first slotted partition. Each second slotted partition has a series of slots extending inwardly from an edge of the second slotted partition. Preferably these slots are evenly spaced in order to make the cells which are formed by the intersecting partitions of identical dimensions. Each of the slots of the first slotted partitions extends inwardly from an edge of the first slotted partition to approximately the mid point of the first slotted partition. Each of the slots of the second slotted partitions extends inwardly from an edge of the second slotted partition to approximately the mid point of the second slotted partition. Although the partition assembly of the present invention preferably comprises slotted partitions, other types of partitions may be used in accordance with the present invention.

The container comprises four walls extending upwardly from a bottom. The walls and bottom of the container define an interior of the container. Preferably the length and width of the interior of the container are greater than the length of the individual partitions of the partition assembly so that the partition assembly may be removably secured inside the interior of the container without deforming or bending any of the individual partitions of the assembly.

The partition assembly is held inside the interior of the container by at least one hook and loop fastener. Each hook and loop fastener comprises a first component secured to an inner surface of the one of the container walls and a second component secured to one of the individual partitions. One of the components of the fastener has a plurality of hooks and the other component has a plurality of loops adapted to engage the hooks of the other component. The first component of the fastener is preferably adhesively secured to an inner surface of the one of the container walls, but may be secured thereto in any other manner. Similarly, the second component of the fastener is preferably adhesively secured to an individual partition, but may be secured thereto in any other manner.

The second component of the hook and loop fastener functions as an extension of the individual partition to which it is secured. However, this component of the hook and loop fastener is flexible and may be bent either direction so as to form a flexible tab. The height of this component of the hook and loop fastener is preferably less than the height of the individual partition to which it is secured. However, the component may be any desired height and any desired length.

DESCRIPTION OF THE PREFERRED EMBODIMENT

Figure 1:
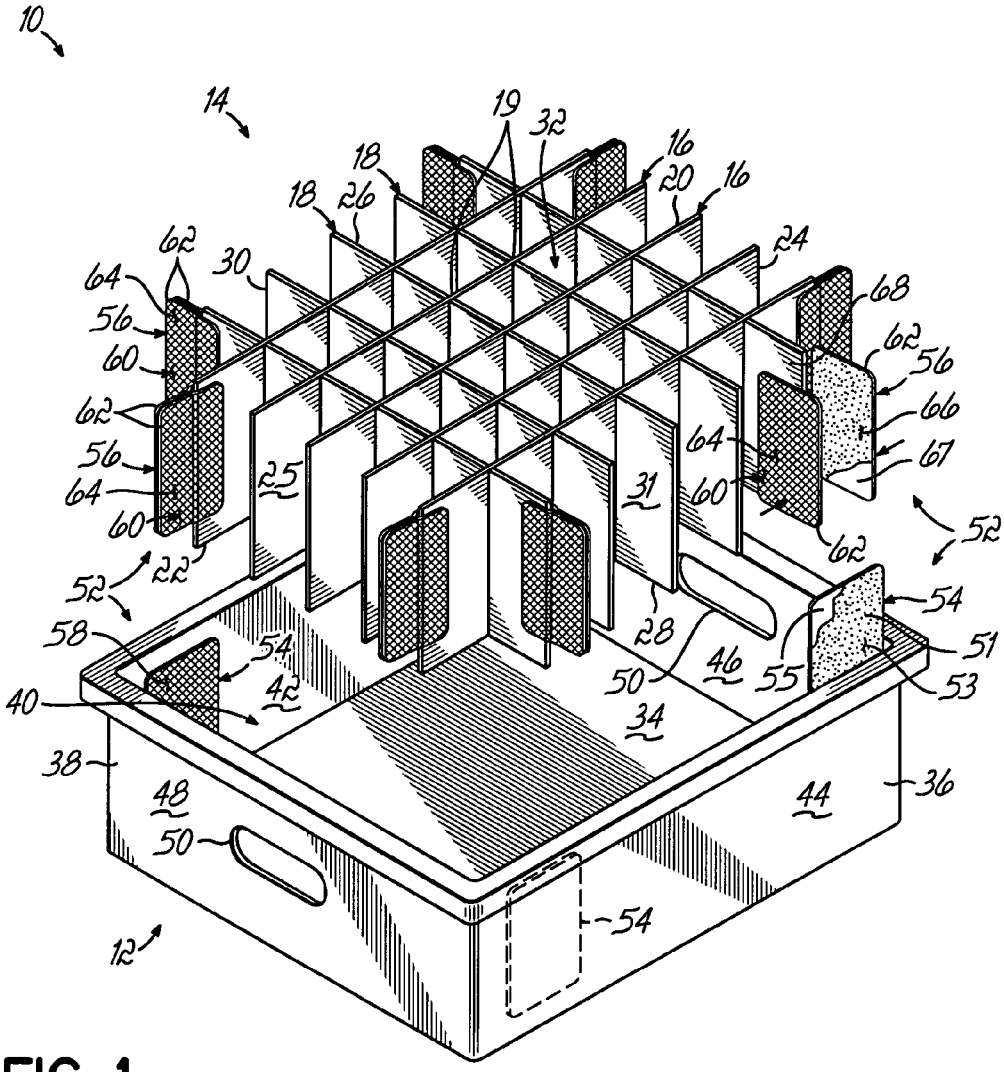
FIG. 1 is a perspective view of a partition assembly and container before the partition assembly is inserted into the interior of the container.

Referring to the drawings and particularly to FIG. 1, there is illustrated the combination 10 of a container 12 and partition assembly or matrix 14 of the present invention for dividing the space inside a container.

The partition assembly 14 comprises a plurality of parallel first slotted partitions 16 intersecting with a plurality of parallel second slotted partitions 18. As shown in FIG. 1, the plurality of first slotted partitions 16 intersect with the plurality of second slotted partitions 18 at intersections 19 to form the partition assembly 14.

Each of the first and second slotted partitions 16, 18 are preferably made of double face plastic with a plurality of spacers therebetween. The spacers may be a plurality of dimples punched out of a middle ply of plastic or a plurality of corrugations. However, the partitions may be made of any material without departing from the spirit of this invention.

Each first slotted partition 16 has a planer top edge 20, a planar bottom edge 22, two vertical side edges 24 and side surfaces 25. Each second slotted partition 18 likewise has a planar top edge 26, a planar bottom edge 28, two vertical side edges 30 and side surfaces 31.

Each first slotted partition 16 has at least one slot (not shown) which extends downwardly from the top edge 20 of the first slotted partition 16 to approximately the mid point of the first slotted partition 16. The slots may be evenly spaced apart in order so that the individual holding cells 32 of the partition assembly 14 may be evenly sized. Alternatively, the slots may be unevenly spaced in order to form holding cells of the partition assembly of differing sizes adapted to accept different size parts. The slots are shown as being vertical but may be horizontal if the partition assembly 14 is placed on edge.

Each second slotted partition 18 has at least one slot (not shown) each slot extending upwardly from the bottom edge 28 of the second slotted partition 18 to approximately the mid point of the second slotted partition 18. The slots of the second slotted partition 18 may also be evenly spaced in order so that the holding cells 32 of the partition assembly 14 may be evenly sized. Alternatively, the slots may be unevenly spaced in order to form holding cells of the partition assembly of differing sizes adapted to accept different size parts. The slots are shown as being vertical but may be horizontal if the partition assembly 14 is placed on edge.

The container or box 12 has a bottom 34, a pair of side walls 36 and a pair of end walls 38. The bottom 34, side and end walls 36, 38 define an interior 40 of the container 12. The side and end walls 36, 38 extend upwardly from the perimeter of the bottom 34 of the container, as is conventional. Each of the side walls 36 has an inner surface 42 and an outer surface 44. Similarly, each of the end walls 38 has an inner surface 46 and an outer surface 48. The linear distance between the inner surfaces 42 of the side walls 36 defines the width W of the interior 40 of the container. Similarly, the linear distance between the inner surfaces 46 of the end walls 38 defines the length L of the interior 40 of the container. See FIG. 2.

Oval shaped holes 50 are shown in FIG. 1 extending through the end walls 38. These holes 50 may be any desired shape, configuration or size and may accommodate hand holds (not shown). Although the holes 50 are illustrated as being formed in the end walls 38, they may alternatively be placed in the side walls 36 or all the walls of the container. Although one configuration of container is illustrated and described, other configurations or types of containers may be used in accordance with the present invention. For example, a container having five or six walls may be used. Alternatively, a cylindrical container having a continuous, circular wall extending upwardly from the bottom of the container may be used.

Figure 2:
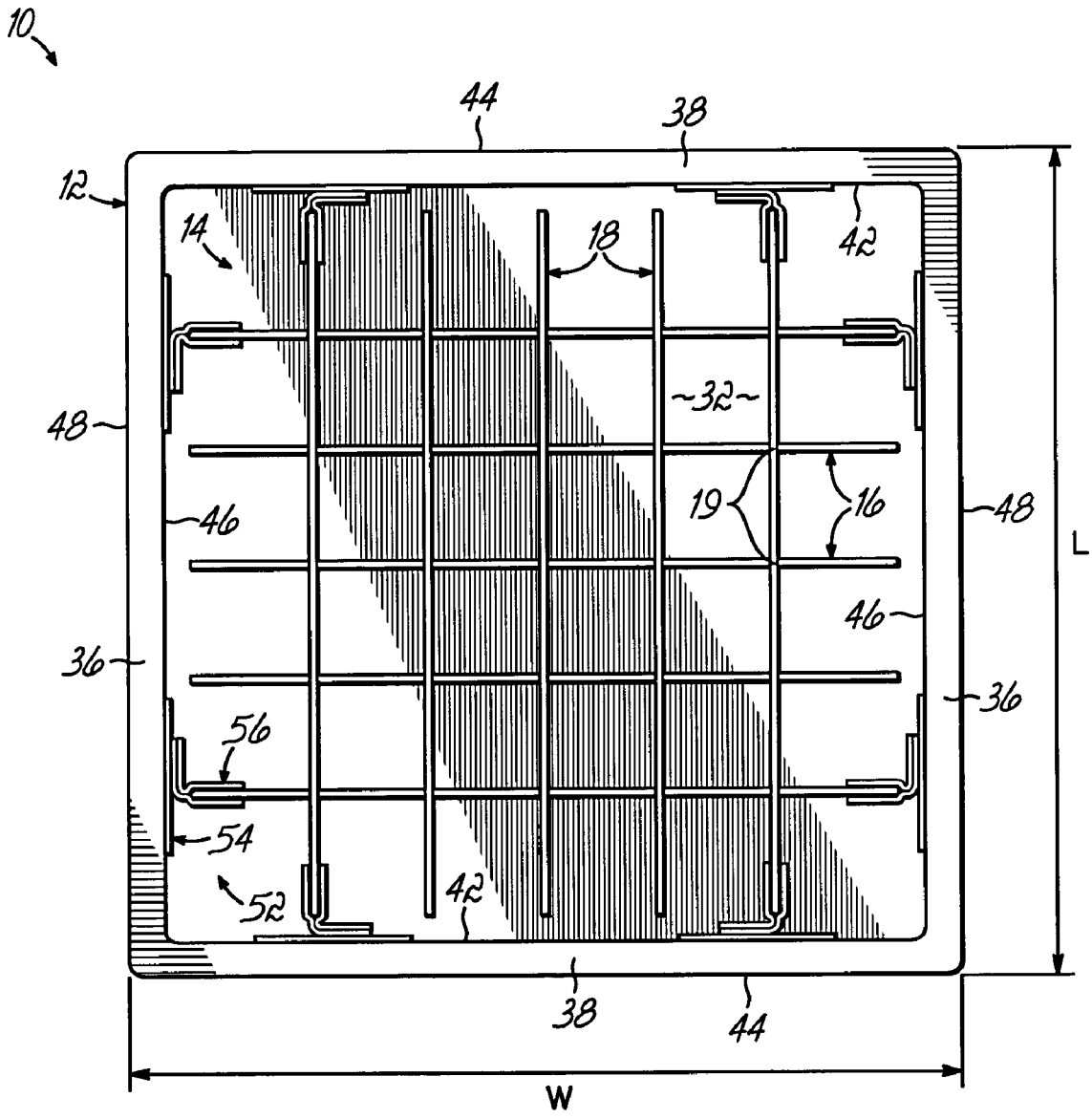
FIG. 2 is a top plan view of the partition assembly and container of FIG. 1, the partition assembly being secured the interior of the container.

The partition assembly 14 is held inside the interior 40 of the container 12 by a plurality of hook and loop fasteners 52 in a manner shown in FIG. 2. Although eight hook and loop fasteners 52 are shown in FIG. 2 to secure the partition assembly 14 inside the interior 40 of the container 12, any number of hook and loop fasteners may be used to secure the partition assembly 14 inside the interior 40 of the container 12.

Each hook and loop fastener 52 comprises a first component 54 and a second component 56. As best illustrated in FIG. 1, the first component 54 is secured to an inner surface of either a side wall 36 or an end wall 38 of the container 12. The first component 54 of the fastener 52 has an outer surface 58 which is either hooks or loops and is adapted to engage an outer surface 60 of the second component 56. If the outer surface 58 of the first component 54 is hooks then the outer surface 60 of the second component is loops or visa versa.

The first component 54 of the hook and loop fastener 52 has an inner surface 51 covered with adhesive 53 and a backing 55 such that upon peeling off the backing 55, the adhesive 53 is exposed. After peeling off the backing 55, the first component 56 of the hook and loop fastener 52 may be adhesively secured to the inner surface of one of the container walls at the desired location. However, any other means of securing the first component 56 of the hook and loop fastener 52 may be used without departing from the spirit of the invention.

In the preferred embodiment of the invention illustrated in FIGS. 1 and 2, the second component 56 of the hook and loop fastener 52 comprises a tab made from two pieces of fabric 62. Each piece of fabric 62 has an outer surface 64 covered with either hooks or loop and an inner surface 66 covered with adhesive and a backing 67 such that upon peeling off the backing, the adhesive is exposed. After peeling off the backing, the piece of fabric 62 is secured to an outer portion 68 of one of the individual partitions 16, 18 of the partition assembly 14. More particularly, the piece of fabric 62 is secured to a side surface of one of the individual partitions 16, 18 of the partition assembly 14. The adhesive on the inner surfaces 66 of the pieces of fabric 62 secured two pieces of fabric 62 together as well as securing each piece of fabric 62 to one of the individual partitions.

When the two pieces of fabric 62 are secured together, they form the second component 56 of the hook and loop fastener 52. The outer surfaces 64 of the pieces of fabric 62 collectively make up the outer surface 60 of the second component 56 of the hook and loop fastener 52. In accordance with the present invention, any other means of securing the second component 56 of the hook and loop fastener 52 to individual partitions 16, 18 may be used without departing from the spirit of the invention.

When the first and second components 54, 56 are engaged together, as shown in FIG. 2, the second component 56 functions as an extension of an individual partition. The second component 56 may be bent either way to engage the first component 58, because the outer surfaces 64 of each piece of fabric 62 are identical.

Figure 1A:
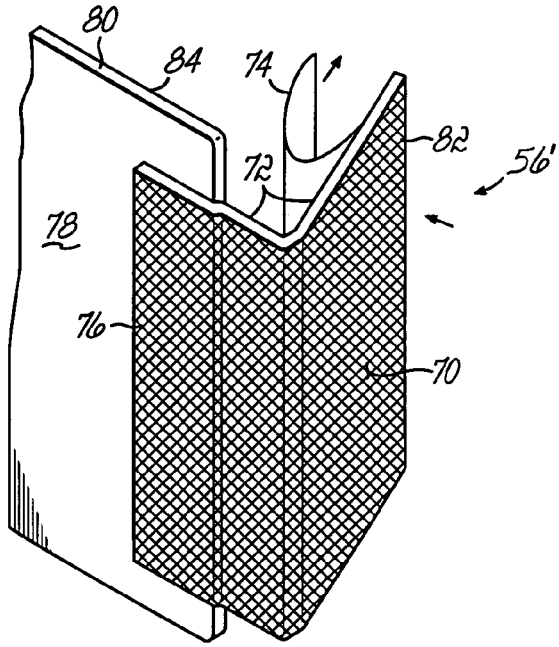
FIG. 1A is a perspective view of a portion of an alternative embodiment of partition assembly.

FIG. 1A illustrates an alternative embodiment of the present invention. In this embodiment, the second component 56' of the hook and loop fastener 52 is slightly different than the second component 56 of the hook and loop fastener 52. Instead of being formed of two pieces of fabric or material, second component 56' is one piece of material. This second component 56' has an outer surface 70 covered with either hooks or loops and an inner surface 72 covered with adhesive (not shown). A backing 74 is placed over the adhesive so that the backing 74 must be removed to expose the adhesive. As shown in FIG. 1A, once the backing 74 is removed, a first portion 76 of the component 56' is adhesively secured to a first side surface 78 of a partition 80 and a second portion 82 of the component 56' is adhesively secured to a second side surface 84 of the partition 80.

Using the present invention, a partition assembly 14 may be removably secured inside the interior of the container by a plurality of hook and loop fasteners without having to bend the partitions.

While I have described only several preferred embodiments of my invention, I do not intend to be limited except by the scope of the following claims:

The invention claimed is:

1. A combination comprising:

a partition assembly including intersecting slotted partitions arranged in a matrix, a container having walls extending upwardly from a bottom, said bottom and said walls of said container defining an interior of said container;

said partitions being of a length such that said partition assembly may fit in said interior of said container without bending said partitions;

wherein said partition assembly is held in said interior of said container by at least one hook and loop fastener and said at least one hook and loop fastener comprises a first component secured to an inner surface of one of said container walls and a second component secured to one of said partitions, wherein said second component is adhesively secured to said one of said partitions.

2. The combination of claim 1 wherein said second component of said hook and loop fastener functions as a flexible extension of said one of said partitions.

3. The combination of claim 1 wherein said second component of said hook and loop fastener has an exterior surface which has a plurality of loops.

4. The combination of claim 1 wherein said second component of said hook and loop fastener is a flexible tab.

5. The combination of claim 1 wherein said partitions are plastic.

6. A combination comprising:

a partition assembly including intersecting slotted partitions arranged in a matrix, a container having walls extending upwardly from a bottom, said bottom and said walls of said container defining an interior of said container;

said partitions being of a length such that said partition assembly may fit in said interior of said container without bending said partitions;

wherein said partition assembly is held in said interior of said container by at least one hook and loop fastener and said at least one hook and loop fastener comprises a first component secured to an inner surface of one of said container walls and a second component secured to one of said partitions, wherein said second component of said hook and loop fastener is a piece of fabric adhesively secured to opposite side surfaces of said one of said partitions.

7. The combination of claim 6 wherein said second component of said hook and loop fastener functions as a flexible extension of said one of said partitions.

8. The combination of claim 6 wherein said second component of said hook and loop fastener has an exterior surface which has a plurality of loops.

9. The combination of claim 6 wherein said second component of said hook and loop fastener is a flexible tab.

10. The combination of claim 6 wherein said partitions are plastic.

11. A combination comprising:

a container having walls extending upwardly from a bottom, said bottom and said walls of said container defining an interior of said container;

a partition assembly including slotted partitions arranged in a matrix, said partitions being of a length such that said partition assembly may fit in said interior of said container without bending said partitions;

wherein said partition assembly is held in said interior of said container by at least one hook and loop fastener comprising a first component secured to an inner surface of one of said container walls and a second flexible component secured to one of said partitions, said second flexible component being adapted to bend both clockwise and counterclockwise relative to said one of said partitions and wherein said second component is adhesively secured to said one of said partitions.

12. A combination comprising:

a container having walls extending upwardly from a bottom, said bottom and said walls of said container defining an interior of said container;

a partition assembly including slotted partitions arranged in a matrix, said partitions being of a length such that said partition assembly may fit in said interior of said container without bending said partitions;

wherein said partition assembly is held in said interior of said container by at least one hook and loop fastener comprising a first component secured to an inner surface of one of said container walls and a second flexible component secured to one of said partitions, said second flexible component being adapted to bend both clockwise and counterclockwise relative to said one of said partitions and wherein said second component of said hook and loop fastener is a piece of fabric adhesively secured to opposite side surfaces of said one of said partitions.

13. The combination of claim 12 wherein said second component of said hook and loop fastener functions as a generally planar extension of said one of said partitions.

14. The combination of claim 12 wherein said second component of said hook and loop fastener has an exterior surface which has a plurality of loops.

15. A combination comprising:

a container having walls extending upwardly from a bottom, said bottom and side walls defining an interior of the container;

a partition assembly for dividing the interior of the container, one component of a two part hook and loop fastener being secured to an inner surface of one of the walls of the container, the partition assembly comprising:

a plurality of first and second slotted partitions arranged in a matrix;

one of the slotted partitions having a flexible tab sandwiched around the end thereof, said flexible tab comprising a second component of the two part hook and loop fastener adapted for engagement with the first component of the two part hook and loop fastener without bending any of the partitions wherein said second component of said two part hook and loop fastener has a removable backing covering an adhesive surface, said adhesive surface adapted to attach to said ends of said slotted partitions.

16. The combination of claim 15 wherein said second component of said two part hook and loop fastener is adapted to planarly extend said partition.

17. A combination comprising:

a container having walls extending upwardly from a bottom, said bottom and side walls defining an interior of the container;

a partition assembly for dividing the interior of the container, one component of a two part hook and loop fastener being secured to an inner surface of one of the walls of the container, the partition assembly comprising:

a plurality of first and second slotted partitions arranged in a matrix;

one of the slotted partitions having a flexible tab sandwiched around the end thereof, said flexible tab comprising a second component of the two part hook and loop fastener adapted for engagement with the first component of the two part hook and loop fastener without bending any of the partitions, wherein said one component of a two part hook and loop fastener has a removable backing covering an adhesive surface, said adhesive surface being secured to an inner surface of one of said walls of said container.

* * * * *